United States Patent [19]

Aoki

[11] Patent Number: 4,513,450

[45] Date of Patent: Apr. 30, 1985

[54] BASEBALL CATCHING MEANS

[75] Inventor: Akio Aoki, Hirakata, Japan

[73] Assignee: Trion Corporation, Osaka, Japan

[21] Appl. No.: 570,318

[22] Filed: Jan. 13, 1984

[30] Foreign Application Priority Data

Dec. 28, 1983 [JP] Japan ..... 58-205107[U]

[51] Int. Cl.[3] ..... A41D 13/10

[52] U.S. Cl. ..... 2/19

[58] Field of Search ..... 2/19, 161 A, 161 R

[56] References Cited

U.S. PATENT DOCUMENTS

| | | | |
|---|---|---|---|
| 862,760 | 8/1907 | Rumrill | 2/19 |
| 906,278 | 12/1908 | Peterson | 2/19 |
| 1,045,231 | 11/1912 | Whitley | 2/19 |
| 1,045,232 | 11/1912 | Whitley | 2/19 |
| 1,064,859 | 6/1913 | Sargent | 2/19 |
| 1,087,292 | 2/1914 | Hooper | 2/19 |
| 1,562,603 | 11/1925 | Turner | 2/19 |
| 2,200,204 | 5/1940 | Le Mat | 2/19 |
| 3,051,958 | 9/1962 | Latina | 2/19 |
| 3,098,234 | 7/1963 | Latina | 2/19 |
| 3,898,696 | 8/1975 | Campanis | 2/19 |

*Primary Examiner*—Werner H. Schroeder
*Assistant Examiner*—J. L. Kravitz
*Attorney, Agent, or Firm*—Jones, Tullar & Cooper

[57] ABSTRACT

In a baseball catching means having a little-finger piece, a thumb piece and three finger pieces of which at least two finger pieces are formed as separated from each other, a connection member for connecting the little-finger piece to the thumb piece through a backstop is extended from the upper end of the little-finger piece and disposed along the upper ends of the three finger pieces.

4 Claims, 2 Drawing Figures

BASEBALL CATCHING MEANS

BACKGROUND OF THE INVENTION

1. Field of the Invention

The present invention relates to a baseball glove, and more particularly to a glove construction in which, except for the thumb piece, at least three finger pieces are formed as separated from one another.

2. Description of the Prior Art

In order to improve the ball catching performance of a baseball glove, it may be effective to increase its ball contact area or to provide a large-size glove.

In manufacturing such large-size baseball gloves, enlargement of the intermediate three finger pieces for the first finger, the second finger and the third finger is limited in space due to the finger size. In this connection, there has been a tendency recently to enlarge the thumb piece and the little-finger piece. However, even with the use of a normal size baseball glove, the little finger having a weak power is hardly turned sufficiently in the inward direction. In a larger glove, the little finger is slower in the inward turning action. Good ball catching cannot be therefore expected.

No proposal has ever been made for reinforcing such weak ball catching performance of the little finger, except for a construction in a normal baseball glove in which the tips of the four finger pieces except the thumb piece are connected to one another with leather strips, as shown in, for example, U.S. Pat. No. 3,098,234.

Such linking construction has been made for making up for the defects produced with the tips of these four finger pieces left free. Namely, when the pressure of a ball caught with a glove acts on the tip of one of the four finger pieces, the ball causes such finger piece tip to be turned outwardly so that the ball escapes from the glove, because the finger tip does not reach the finger piece tip and the ball power can hardly be suppressed by the mere power of one finger. The object of such linking construction in which the respective finger piece tips are connected to one another, is to prevent the ball from escaping from the glove. Therefore, connection of the little-finger piece to the adjacent third-finger piece has not been made for reinforcing the ball catching performance of the little-finger piece. Even though such connection is effective in reinforcing the ball catching performance of the little-finger piece, an extremely small effect is merely expected.

As to baseball mitts, reference is made to, for example, the U.S. Pat. No. 3,051,958 which discloses a baseball mit having a large ball-catching area.

Mitts are generally constructed such that the four fingers except the thumb are inserted into one finger piece. Accordingly, even if the ball catching area is enlarged in a mitt, such enlargement does not produce trouble as in a glove, since the weak power of the little finger is reinforced directly by the other three fingers. However, a mitt lacks such advantage that each of the fingers performs an independent ball catching action as a glove does.

SUMMARY OF THE INVENTION

It is an object of the present invention to remedy the defects of a conventional baseball glove of the type abovementioned, and to provide a baseball catching means having an excellent ball catching ability.

In order to achieve such an object, the baseball catching means in accordance with the present invention has a little-finger piece, a thumb piece, and three finger pieces of which at least two finger pieces are formed as separated from each other, and is characterized in that a connection member for connecting the little-finger piece to the thumb piece through a backstop is extended from the upper end of the little-finger piece and disposed along and on the upper ends of the intermediate three finger pieces.

According to the baseball catching means of the present invention, when the respective fingers are turned inwardly for catching a ball and the little-finger piece is struck by the ball which is apt to turn the little-finger piece, outwardly the tractive force of the connection member prevents the little-finger piece from being twined outwardly, because the little-finger piece is connected to the thumb piece through the backstop. With the ball power suppressed, the ball is then introduced to the glove center portion, thus assuring secure ball catching.

When the backstop is struck by a ball, the connection member tends to inwardly turn the little-finger piece inwardly around that portion of backstop which is just struck by the ball. More effective ball catching can therefore be assured.

When the connection member for connecting the little-finger piece to the thumb pieces as mentioned earlier, has a ball catching space, not only the entire ball catching area of the glove is enlarged to improve the ball catching ability, but also the ball catching performance of the little finger having a weak power is securely reinforced.

Other advantages of the present invention will be apparent from the following description.

DESCRIPTION OF THE PREFERRED EMBODIMENT

Figure 1:
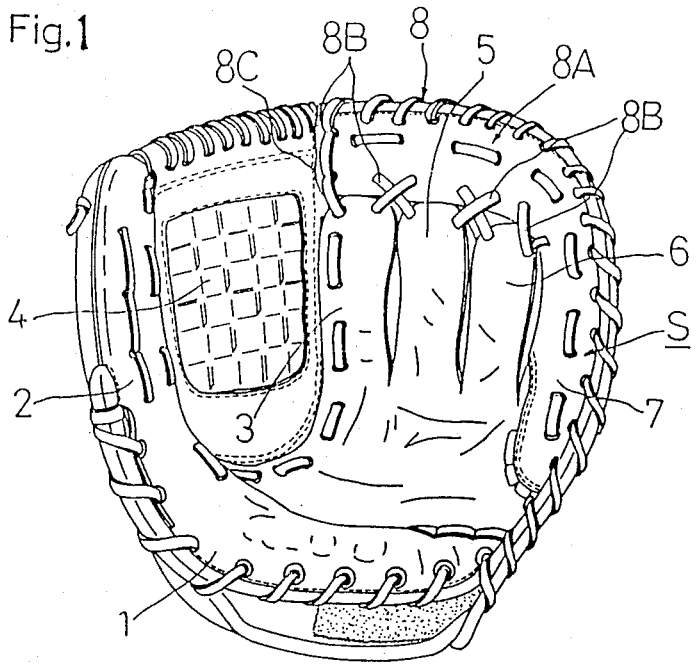
FIG. 1 is a general front view of baseball catching means in accordance with the present invention.
Figure 2:
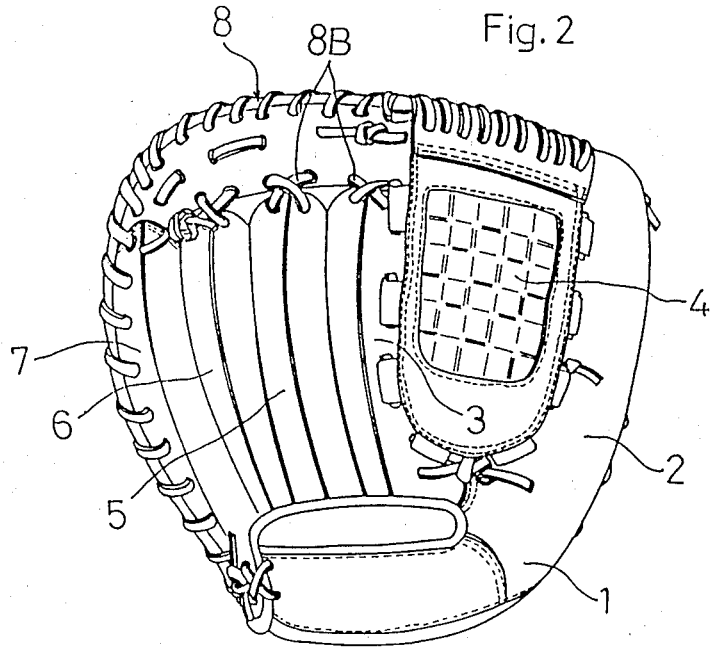
FIG. 2 is a general back view of FIG. 1.

In FIGS. 1 and 2, the baseball glove in accordance with the present invention has a main body 1, a thumb piece 2, a first-finger piece 3, a backstop 4 between the thumb piece 2 and the first-finger piece 3, a second-finger piece 5, a third-finger piece 6 and a little-finger piece 7, these finger pieces 5,6,7 and 3 being formed as separated from one another.

There is also disposed a connection member 8 for connecting the little-finger piece 7 to the other three finger pieces 3,5 and 6. The connection member 8 is integrally formed with the little-finger piece 7, and includes an additional ball catching portion 8A disposed along and on the tips of the third-finger piece 6, the second-finger piece 5 and the first-finger piece 3. This ball catching portion 8A is connected to the tips of the first-finger piece 3, the second-finger piece 5 and the third-finger piece 6 with a strap member 8B. The additional ball catching portion 8A has a width substantially the same as that of the ball catching space of the tip of the little-finger piece 7, and is generally formed in a reverse L-shape.

The additional ball catching portion 8A is connected at its tip 8C to the upper portion of the backstop 4 with the strap member 8B.

The little-finger piece 7 has a ball catching space S larger than that of each of the other three finger pieces 3,5 and 6 and of the thumb piece 2.

The thumb piece 2 has a length longer than those of the three finger pieces 3,5 and 6, by a distance corresponding to the width of the additional ball catching portion 8A in the finger lengthwise direction. There is thus formed a substantially straight line for the imaginary line passing through the upper end of the thumb piece 2, the upper edge of the backstop 4 and the upper edge of the additional ball catching portion 8A on the third-finger piece 6.

According to the present invention, the connection member 8 may be constructed without having the additional ball catching portion 8A, as far as the little-finger piece 7 can be connected directly to the thumb piece 2 through the backstop 4.

The present invention may be applied to a conventional glove in which the four finger pieces except the thumb piece are connected to one another.

I claim:

1. A baseball glove, comprising:

a main body;

a thumb piece;

three finger pieces formed shorter than said thumb piece and each defining an upper end;

a little-finger piece, said thumb piece and three finger pieces being formed separately from each other, said thumb piece, three finger pieces and little-finger piece being connected to and extending from the main body;

a back stop disposed between said thumb piece and one of said finger pieces adjacent said thumb piece to connect said thumb piece and said finger-piece; and a connection member formed integrally with said little-finger piece, said connection member being disposed along and connected to the upper ends of said three finger pieces and connected to said back stop, said connection member defining a ball catching surface along its extent.

2. The baseball glove as defined in claim 1, further comprising:

a strap member for connecting the connection member to the three finger pieces at their upper end, and wherein said connection member is formed substantially in a reverse L-shape.

3. The baseball glove as defined in claim 2, wherein the connection member is connected to the back stop by said strap member.

4. The baseball glove as defined in claim 2, wherein the three finger pieces and the little-finger piece each define a ball catching surface, and wherein the ball catching surface of the little-finger piece is larger than the ball catching surface of the three finger pieces.

* * * * *